US009253855B2

(12) United States Patent
Van Kaathoven et al.

(10) Patent No.: US 9,253,855 B2
(45) Date of Patent: Feb. 2, 2016

(54) TUNABLE LIGHTING SYSTEM

(71) Applicant: KONINKLIJKE PHILIPS N.V., Eindhoven (NL)

(72) Inventors: Dirk Jan Van Kaathoven, Eindhoven (NL); Erik Martinus Hubertus Petrus Van Dijk, Den Bosch (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 0 days.

(21) Appl. No.: 14/402,552

(22) PCT Filed: May 28, 2013

(86) PCT No.: PCT/IB2013/054387

§ 371 (c)(1),
(2) Date: Nov. 20, 2014

(87) PCT Pub. No.: WO2013/179215

PCT Pub. Date: Dec. 5, 2013

(65) Prior Publication Data

US 2015/0108921 A1 Apr. 23, 2015

Related U.S. Application Data

(60) Provisional application No. 61/652,375, filed on May 29, 2012.

(51) Int. Cl.
*H05B 37/02* (2006.01)
*H05B 33/08* (2006.01)

(52) U.S. Cl.
CPC ..... *H05B 37/0209* (2013.01); *H05B 33/0863* (2013.01); *H05B 33/0866* (2013.01)

(58) Field of Classification Search
CPC ..... H05B 33/0815; H05B 33/0818; H05B 37/029; H05B 37/02; H05B 33/0866; H05B 33/0857; H05B 37/0259; H05B 33/0869
USPC ..... 315/297, 307, 294, 151, 312, 318, 360, 315/362; 382/274, 164, 167
See application file for complete search history.

(56) References Cited

U.S. PATENT DOCUMENTS 5,384,519 A 1/1995 Gotoh
7,703,943 B2 4/2010 Li et al.

(Continued)

FOREIGN PATENT DOCUMENTS

NL WO 2009066198 A1 * 5/2009 ..... H05B 33/086
WO 2007033667 A1 3/2007

(Continued)

*Primary Examiner* — Douglas W Owens
*Assistant Examiner* — Syed M Kaiser
(74) *Attorney, Agent, or Firm* — Meenakshy Chakravorty

(57) ABSTRACT

A method for providing a light output from a lighting system (100) capable of emitting light within a lighting system color gamut (202) in an x-y color plane, comprising the steps of: receiving (302) a light output target comprising a target color point (210, 219) and a target flux; comparing (304) the target color point with the lighting system color gamut (202); and if the target color point is outside of the color gamut: determining (310) a first approximation color point (212, 220) inside the color gamut based on a minimization of a distance in the x-y color plane between the target color point and the first approximation color point; determining (312) a highest possible flux achievable by the lighting system at the first approximation color point; if the highest possible flux achievable by the lighting system at the first approximation color point is equal to or larger than the target flux, control (309) the lighting system to provide light defined by the first approximation color point and the target flux; and if the highest possible flux achievable by the lighting system at the first approximation color point is lower than the target flux, determining (314) a second approximation color point (214, 222) at which the lighting system is capable of providing the target flux based on a minimization of a distance in the x-y color plane between the first approximation color point and the second approximation color point; and controlling (315) the lighting system to provide light defined by the second approximation color point and the target flux.

15 Claims, 3 Drawing Sheets

(56) References Cited

U.S. PATENT DOCUMENTS

| | | | | |
|---|---|---|---|---|
| 2006/0098077 | A1 | 5/2006 | Dowling | |
| 2009/0002604 | A1 | 1/2009 | Morimoto | |
| 2011/0057571 | A1 | 3/2011 | Ackermann et al. | |
| 2012/0001555 | A1 | 1/2012 | Tu et al. | |
| 2012/0126707 | A1* | 5/2012 | Kropf | G01J 1/32 315/151 |
| 2012/0154626 | A1* | 6/2012 | Hatakeyama | H04N 9/646 348/223.1 |

FOREIGN PATENT DOCUMENTS

| | | | |
|---|---|---|---|
| WO | 2008099997 | A1 | 8/2008 |
| WO | 2008139369 | A1 | 11/2008 |
| WO | 2009066198 | A1 | 5/2009 |

* cited by examiner

TUNABLE LIGHTING SYSTEM

Cross-Reference to Prior Applications

This application is the U.S. National Phase application under 35 U.S.C. §371 of International Application No. PCT/IB2013/054387, filed on May 28, 2013, which claims the benefit of U.S. Provisional Patent Application No. 61/652,375, filed on May 29, 2012. These applications are hereby incorporated by reference herein.

FIELD OF THE INVENTION

The present invention relates to a variable color lighting system and a method and a controller for controlling color output of such a variable color lighting system. In particular, the present invention relates to a method for determining a color point in a variable color lighting system.

BACKGROUND OF THE INVENTION

A current trend in lighting is that light is more and more used for creating an atmosphere rather than for just illumination. Lighting systems suitable as "atmosphere providers" need to be capable of emitting light of different colors as well as being variable in intensity (dimmable). Ideally, such lighting systems should be variable over the entire color triangle (for example in the xy-plane of the CIE XYZ-system) perceptible by a human eye. In reality, however, a color variable lighting system can span only a part of the color triangle. For a particular color variable lighting system, this part of the color triangle is referred to as the color gamut of the lighting system. Moreover, different lighting systems generally have different color gamuts.

U.S. Pat. No. 5,384,519 discloses an example of such a variable color lighting system in which light from at least three dimmable mono-color light sources is mixed in order to emit light of a desired color. When the different LEDs are far apart in color space (as is the case with RGB), making colors in the centre of the range (whites) is relatively simple and the possible range and flux is relatively independent of the exact position of the primaries. However, a disadvantage of such a system is the sensitivity of color point in relation to color temperature and a rather limited color rendering index (CRI).

Since the color gamut of any variable color lighting system only spans a part of the color triangle, there is always a possibility that a user may request light of a color outside the color gamut of the lighting system. As the light sources in a color system may be slightly different between one system and the next due to uncontrollable variations in the fabrication process, two apparently similar lighting systems may provide slightly different color gamuts. The uncertainty in which color can be provided be the lighting system can for example be eliminated by limiting the allowable gamut of the modules to the minimal gamut that can always be guaranteed. However, such a limitation would be excessive in most cases.

Furthermore, there are known solutions for approximating a color point within an allowable gamut if a requested color lies outside of the allowable gamut. However, merely approximating a new color point within the allowable gamut, for example the nearest point within the gamut, may provide a color which is perceived as significantly different from the requested color with respect to color temperature and CRI.

SUMMARY OF THE INVENTION

It is an object of the present invention to provide an improved lighting system and a method for controlling such a lighting system.

According to a first aspect of the invention, this and other objects are achieved by a method for providing a light output from a lighting system capable of emitting light within a lighting system color gamut in an x-y color plane, comprising the steps of: receiving a light output target comprising a target color point and a target flux; comparing the target color point with the lighting system color gamut; and if the target color point is outside of the color gamut: determining a first approximation color point inside the color gamut based on a minimization of a distance in the x-y color plane between the target color point and the first approximation color point; determining a highest possible flux achievable by the lighting system at the first approximation color point; if the highest possible flux achievable by the lighting system at the first approximation color point is equal to or larger than the target flux, control the lighting system to provide light defined by the first approximation color point and the target flux.; and if the highest possible flux achievable by the lighting system at the first approximation color point is lower than the target flux, determining a second approximation color point at which the lighting system is capable of providing the target flux based on a minimization of a distance in the x-y color plane between the first approximation color point and the second approximation color point; and control the lighting system to provide light defined by the second approximation color point and the target flux.

The flux of the lighting system refers to the radiant flux provided by the combination of light sources comprised in the lighting system. The flux output as well as the color output of the system may be controlled by controlling the duty cycle of the respective light sources comprised in the system.

The x-y color plane should in the present context be understood as a color plane in a color system where colors may be described by an x coordinate and an y coordinate. Examples of such color systems include, but are not limited to, CIEXYZ, CIELUV, CIELAB, CIEUVW, RGB and CMYK.

The present invention is based on the realization that when a lighting system receives a request for a light output outside of the possible color gamut for various reasons, merely providing the nearest color point within the gamut may not provide the light output most resembling the requested light output as perceived by a user, and that a better approximation may be achieved by taking the flux of the requested light output into account. There is thus a need for an improved lighting system which is capable of handling requested out-of-gamut color points in a satisfactory way.

Accordingly, a light output more resembling the requested light output may be achieved by moving the received target color point in the x-y color plane to the color point within the possible color gamut most closely resembling the requested color where the requested target flux can be achieved. Thereby, an improved approximation of a requested color point which is outside the color gamut with respect to color rendering index and color temperature can be emitted by the lighting system.

Through various embodiments of the method according to the present invention, a requested color point which is outside the lighting system color gamut may be approximated such that a user most of the time is unaware that an out-of-gamut color had been requested. Such a result would be unlikely to obtain by merely passively allowing one or more light sources comprised in the lighting system to saturate when a color request is received, which corresponds to an output unreachable by the lighting device.

The invention is relevant for tunable lighting systems in general, and in particular for tunable white lighting systems for use both in homes as well as in professional applications such as office lighting and retail.

According to one embodiment of the invention, the step of determining a first approximation color point may comprise determining the first approximation color point as the nearest color point within the gamut. A straight forward manner of approximating a requested color point which is outside of the color gamut is to select the nearest color point within the gamut.

In one embodiment of the invention, the step of determining a highest possible flux achievable by the lighting system at the first approximation color point may comprise determining the maximum duty cycles for light sources comprised in the lighting system at the first approximation color point. When a color point within the gamut has been found, it is determined if the target flux is achievable at the first approximation color point. The maximum achievable flux at a given color point can be determined by calculating the maximum duty cycle for the light sources comprised in the lighting system such that the same color point in the x-y color plane is maintained. If the target flux can be reached at the first approximation color point, that color point is used to provide the light output of the lighting system.

According to one embodiment of the invention, the second approximation color point may be determined if the highest possible flux achievable by the lighting system at the first approximation color point is lower than the target flux by a predefined threshold value. Generally, if the target flux cannot be achieved at the first approximation color point, a second approximation color point able to provide sufficient flux is determined. However, for some circumstances, it may be desirable to use the first approximation point as a light output point even if the target flux cannot be achieved, if the maximum achievable flux is close to the target flux. For example, if the achievable flux is within a predetermined threshold value of the target flux, such as at least 95%, the first approximation point may be used as the light output point.

In one embodiment of the invention, the lighting system color gamut may be a triangular gamut in an x-y color plane defined by three light sources. Three arbitrary, different, light sources may be used in the lighting system to define the achievable color gamut.

According to one embodiment of the invention, the step of determining the second approximation color point may comprise determining the nearest point, on a straight line in the x-y color plane from the first approximation color point to the corner of the triangular gamut being at the greatest distance from the first approximation color point, having a flux equal to the target flux. One reason for not being able to meet a flux target at the first approximation point may be that the utilization of one of the three light sources is significantly lower than the utilization of the other two. In such a situation, a color point having sufficient flux may be achieved by moving in the x-y color plane towards the light source having the lowest utilization, which is the light source at the greatest distance from the first approximation point in the x-y color plane. Accordingly, the second approximation point may be determined as the point on the line towards the lowest utilized light source where a flux equal to the target flux point may be achieved.

In one embodiment of the invention, the step of determining the second approximation color point may comprise determining the nearest point, on a straight line in the x-y color plane from the first approximation color point to a point where a duty cycle of each of the two most distant light sources is equal to one, having a flux equal to the target flux. Another reason for not being able to meet a flux target at the first approximation point may be that the utilization of two of the three light sources is significantly lower than the utilization of the remaining one. In such a situation, a color point having sufficient flux may be achieved by moving in the x-y color plane towards the point where the two most distant light sources have a duty cycle equal to one, assuming zero duty cycle for the third light source closest to the first approximation point. The point where the two light sources have the maximum duty cycle is found on the line between the two light sources defining the border of the gamut. Accordingly, the second approximation point may be determined as the point on the line towards the max flux point for the combination of the two most distant light sources where a flux equal to the target flux point may be achieved.

According to one embodiment, the light output target may be on the blackbody line. In many lighting applications both for home use and in office lighting systems, it may be desirable to provide white light on the blackbody line having a predetermined color temperature.

In one embodiment of the invention, the light output target may have a color temperature between 2000K and 3800K.

According to a second aspect of the invention, there is provided a lighting system comprising: at least three light sources defining a lighting system color gamut in an x-y color plane; and a lighting system controller configured to control a light output from the lighting system, wherein the lighting system controller is configured to: receive a light output target comprising a target color point and a target flux; compare the target color point with the lighting system color gamut; and if the target color point is outside of the color gamut: determine a first approximation color point inside the color gamut based on a minimization of a distance in the x-y color plane between the target color point and the first approximation color point; determine a highest possible flux achievable by the lighting system at the first approximation color point; if the highest possible flux achievable by the lighting system at the first approximation color point is equal to or larger than the target flux, control the lighting system to provide light defined by the first approximation color point and the target flux; and if the highest possible flux achievable by the lighting system at the first approximation color point is lower than the target flux, determine a second approximation color point at which the lighting system is capable of providing the target flux based on a minimization of a distance in the x-y color plane between the first approximation color point and the second approximation color point; and control the lighting system to provide light defined by the second approximation color point and the target flux.

The lighting system controller may include a microprocessor, microcontroller, programmable digital signal processor or another programmable device. The lighting system controller may also, or instead, include an application specific integrated circuit, a programmable gate array or programmable array logic, a programmable logic device, or a digital signal processor. Where lighting system controller includes a programmable device such as the microprocessor, microcontroller or programmable digital signal processor mentioned above, the processor may further include computer executable code that controls operation of the programmable device.

In one embodiment of the invention, each of the light sources in the lighting system may comprise a plurality of light emitting devices.

Furthermore, the lighting system may be configured so that each of the light sources emits light within a predetermined distance from the black body line in the x-y color plane. In application where white light of a given color temperature and a high color rendering index is desirable, it may be advantageous to select light sources emitting light as close to the blackbody line as possible.

According to one embodiment of the invention, the aforementioned predetermined distance from the black body line may advantageously be less than 3 SDCM (Standard Deviation of Color Matching). A color difference of 3 SDCM in the x-y color plane is barely noticeable to an observer. Accordingly, it is desirable to provide white light differing less than 3 SDCM from the blackbody line for an observer to not detect any difference in color rendering or hue of color in the white light.

In one embodiment of the invention, the light sources may advantageously emit essentially white light having different color temperature.

Furthermore, the light sources may advantageously emit light having color temperatures approximately equal to 2000K, 2700K, and 4400K, respectively.

Further effects and features of this second aspect of the present invention are largely analogous to those described above in connection with the first aspect of the invention.

Further features of, and advantages with, the present invention will become apparent when studying the appended claims and the following description. The skilled person will realize that different features of the present invention may be combined to create embodiments other than those described in the following, without departing from the scope of the present invention.

BRIEF DESCRIPTION OF THE DRAWINGS

This and other aspects of the present invention will now be described in more detail, with reference to the appended drawings showing embodiments of the invention.

DETAILED DESCRIPTION

In the present detailed description, various embodiments of a lighting system according to the present invention are mainly discussed with reference to a lighting system for providing white light. It should be noted that this by no means limits the scope of the present invention which is equally applicable to a variable color lighting system.

Figure 1:
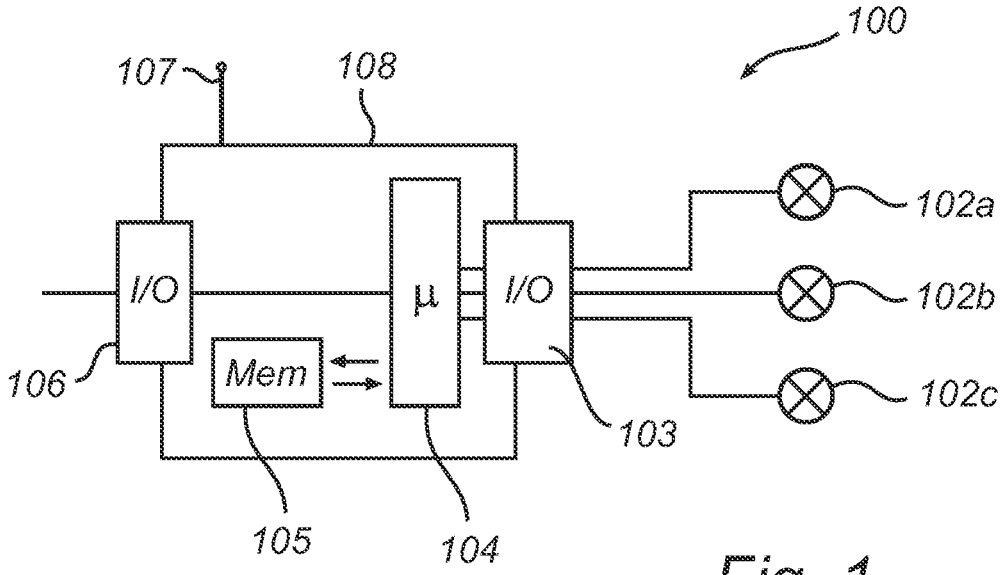
FIG. 1 schematically shows a block diagram illustrating an embodiment of the lighting system according to the present invention.

In FIG. 1, a block diagram representation of an embodiment of the lighting system 100 according to the present invention is schematically shown.

Referring to FIG. 1, a tunable lighting system 100 is shown comprising three light sources 102*a-c*, a light-source interface 103, a lighting system controller 108, including a microprocessor 104, a memory 105, such as a RAM or a non-volatile memory, and an external interface 106. The exemplary lighting system 100 is powered via an external power connection 107. Of course, an internal power supply, such as a battery, could also be used. The light source interface 103 and the external interface 106 may also be wireless interfaces.

The micro-processor 104 receives light output requests via the external interface 106 and, following processing, forwards the request to the light sources 102*a-c* via the light-source interface 103.

The light-sources 102*a-c* are intensity controllable (dimmable) and may be controlled to output light of their respective colors at relative intensities, or duty-cycles, from 0% to 100%.

Figure 2A:
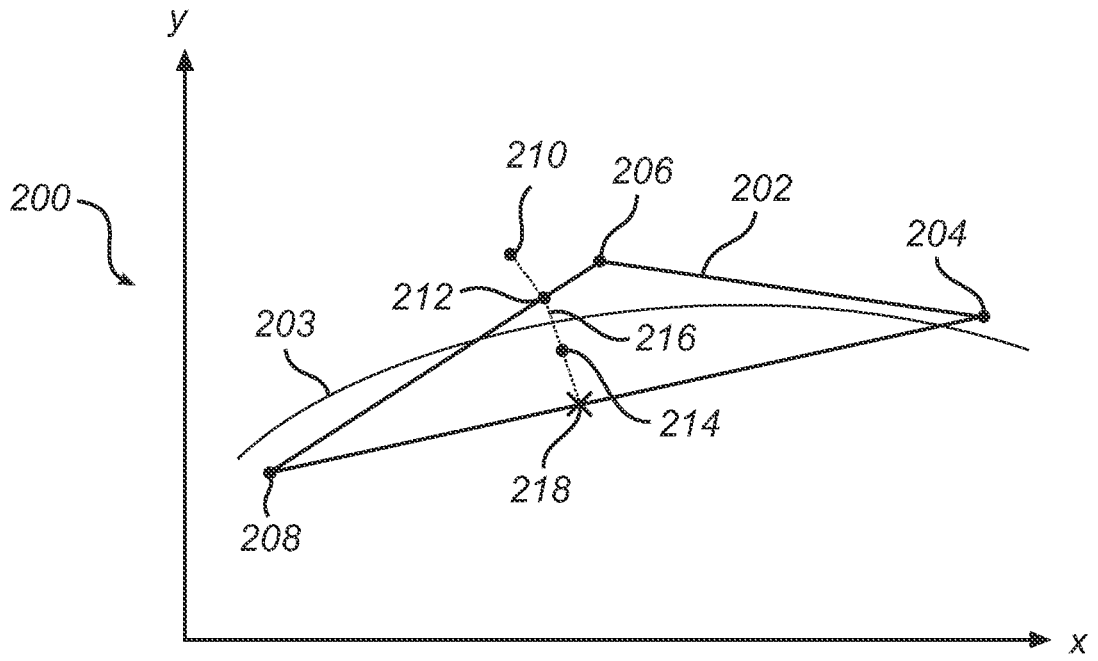
FIGS. 2*a* and 2*b* are graphs schematically illustrating the general method according to embodiments of the invention in an x-y color plane.
Figure 2B:
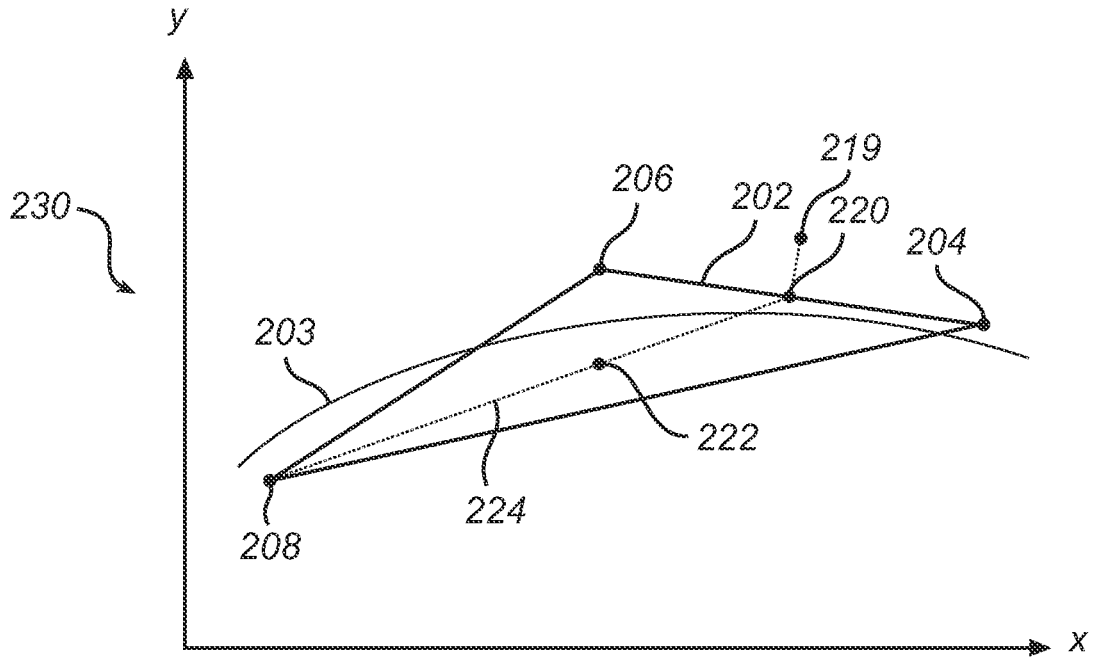

In FIGS. 2*a* and 2*b*, the method according to an embodiment of the invention is schematically illustrated in graphs 200 and 230 showing an allowable color gamut 202 in a color x-y plane defined by the three color points 204, 206, and 208, corresponding to the three light sources 102*a*, 102*b*, and 102*c*, for two different color targets 210 and 219. In the present example, the three light sources are seen as emitting essentially white light having different color temperatures, with light source 204 having a color temperature of approximately 2000K, light source 206 having a color temperature of approximately 2700K and light source 208 having a color temperature of approximately 4400K. The blackbody line 203 is included in the graph 200 for reference. The three light sources may for example constitute light emitting devices providing neutral white light (208), warm white light (206) and phosphor converted amber light (204). The selected phosphor converted amber (PC-amber) light emitting device 204 generally has a color point range between 0.55 and 0.585 for the x coordinate and between 0.41 and 0.44 for the y coordinate in as defined in a CIE 1931 xy chromaticity diagram.

Figure 3:
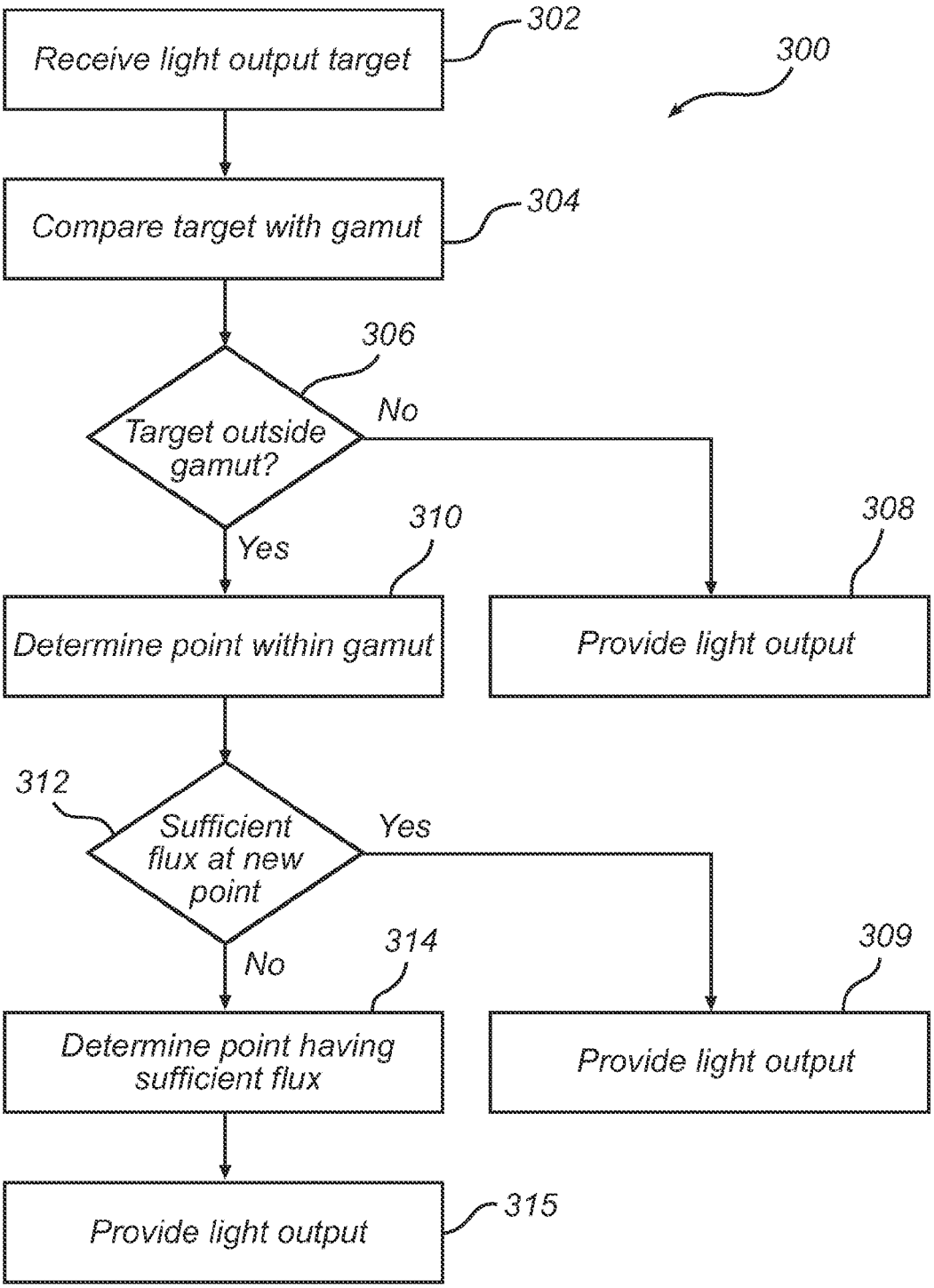
FIG. 3 is a flow chart outlining the general steps of the method according to an embodiment of the invention.

FIG. 3 is a flow chart 300 outlining the general steps of the method according to an embodiment of the invention which will be described with reference to the lighting system 100 illustrated in FIG. 1 and to the x-y color plane 200 shown in FIG. 2*a*.

First, in step 302, a light output target is received by the lighting system. The light output target comprises a target color, illustrated as point 204 in the graph 200, and a target flux. In step 304, the target color point 210 is compared with the color gamut 202. If the color point 210 is within the gamut 202, a light output according to the target color point 210 may be provided 308 by the lighting system. In the present example, it is concluded in step 306 that the target color point 210 is outside of the color gamut 202. Then, the next step 310 is to determine a color point which is within the gamut, here referred to as a first approximation color point 212. The first approximation color point 212 is defined as the point closest to the target color point 210 which is within the color gamut 202. Next, in step 312, a comparison is made as to if the highest possible flux achievable by the lighting system at the first approximation color point 212 is equal to or larger than the target flux. If the target flux is achievable at the first approximation color point 212, a light output according to the first approximation color point 212 may be provided 309 by the lighting system.

If it is concluded in step 312 that the target flux is not achievable at the first approximation color point 212, step 314 involves determining a color point where the target flux is achievable, here referred to as the second approximation color point 214. Once this second approximation color point 214 has been determined, the light output is provided in step 315. The determination of the second approximation color point 214 is based on a minimization of a distance in the x-y color plane between the first approximation color point 212 and a color point capable of achieving the target flux. In particular, two examples of how the second approximation color point may be determined depending on where the first approximation color point is located are illustrated in FIG. 2*a* and FIG. 2*b*.

In FIG. 2*a*, the first approximation color point 212 is significantly closer to one of the light sources, here 206, than to the other two light sources 204 and 208. In such a scenario, the second approximation color point 214 can be found on a straight line 216 in the x-y color plane from the first approximation color point 212 to a point 218 where a duty cycle of each of the two most distant light sources is equal to one. The point 218 represents the max-flux point for the combination of the two light sources 204 and 208.

In FIG. 2*b*, for the color target point 219, the first approximation color point 220 is at an approximately equal distance to two of the light sources, 204 and 206, meaning that the third light source 208 is under-utilized. In such a scenario, the second approximation color point 222 can be found on a straight line 224 in the x-y color plane from the first approximation color point 220 to the light source 208 being at the greatest distance from the first approximation color point 220.

It should be noted that the graphs in FIG. 2*a* and FIG. 2*b* are not drawn to scale, ant that they merely illustrate the general principle of the method and system according to embodiments of the invention.

As each color point in the gamut is determined by the relation of the flux between the different light sources, the achievable flux range for each color point within the gamut can be determined. Furthermore, as the distance between a given color point and any other point within or outside of the gamut may be calculated using basic trigonometry or vector calculus, based on the above examples, a color point within the gamut where the target flux can be achieved can be calculated.

A lighting system according to various embodiments of the invention may further comprise a feed-forward control where the actual flux of each light source can be continuously calculated based on heat sink temperatures and junction temperatures of the light emitting devices comprised in the light sources. Accordingly, the duty cycle of the light sources may be continuously updated to keep the light output color point constant.

Even though the invention has been described with reference to specific exemplifying embodiments thereof, many different alterations, modifications and the like will become apparent for those skilled in the art. For example, light sources having different colors may be used, and the method according to embodiments of the invention may be used to generally reduce a perceived difference between a desired color point and an approximated color point in a lighting system.

Additionally, variations to the disclosed embodiments can be understood and effected by the skilled person in practicing the claimed invention, from a study of the drawings, the disclosure, and the appended claims. In the claims, the word "comprising" does not exclude other elements or steps, and the indefinite article "a" or "an" does not exclude a plurality. The mere fact that certain measures are recited in mutually different dependent claims does not indicate that a combination of these measured cannot be used to advantage.

The invention claimed is:

1. Method for providing a light output from a lighting system capable of emitting light within a lighting system color gamut in an x-y color plane, comprising the steps of:

receiving a light output target comprising a target color point and a target flux;

comparing said target color point with said lighting system color gamut; and if said target color point is outside of said color gamut:

determining a first approximation color point inside said color gamut based on a minimization of a distance in said x-y color plane between said target color point and said first approximation color point;

determining a highest possible flux achievable by said lighting system at said first approximation color point;

if said highest possible flux achievable by the lighting system at said first approximation color point is equal to or larger than said target flux, control said lighting system to provide light defined by said first approximation color point and said target flux; and if said highest possible flux achievable by the lighting system at said first approximation color point is lower than said target flux, determining a second approximation color point at which said lighting system is capable of providing said target flux based on a minimization of a distance in said x-y color plane between said first approximation color point and said second approximation color point; and controlling said lighting system to provide light defined by said second approximation color point and said target flux.

2. The method according to claim 1, wherein the step of determining a first approximation color point comprises determining said first approximation color point as the nearest color point within the gamut.

3. The method according to claim 1, where the step of determining a highest possible flux achievable by said lighting system at said first approximation color point comprises determining the maximum duty cycles for light sources comprised in the lighting system at said first approximation color point.

4. The method according to claim 1, wherein said second approximation color point is determined if said highest possible flux achievable by the lighting system at said first approximation color point is lower than said target flux by a predefined threshold value.

5. The method according to claim 1, wherein said lighting system color gamut is a triangular gamut in an x-y color plane defined by three light sources.

6. The method according to claim 5, wherein the step of determining said second approximation color point comprises determining the nearest point, on a straight line in the x-y color plane from said first approximation color point to the corner of the gamut being at the greatest distance from said first approximation color point, having a flux equal to said target flux.

7. The method according to claim 5, wherein the step of determining said second approximation color point comprises determining the nearest point, on a straight line in the x-y color plane from said first approximation color point to a point where a duty cycle of each of the two most distant light sources is equal to one, having a flux equal to said target flux.

8. The method according to claim 1, wherein said light output target is on the blackbody line.

9. The method according to claim 1, wherein said light output target has a color temperature between 2000K and 3800K.

10. A lighting system comprising:

at least three light sources defining a lighting system color gamut in an x-y color plane; and a lighting system controller configured to control a light output from said lighting system, wherein said lighting system controller is configured to:

receive a light output target comprising a target color point and a target flux;

compare said target color point with said lighting system color gamut; and if said target color point is outside of said color gamut:

determine a first approximation color point inside said color gamut based on a minimization of a distance in said x-y color plane between said target color point and said first approximation color point;

determine a highest possible flux achievable by said lighting system at said first approximation color point;

if said highest possible flux achievable by the lighting system at said first approximation color point is equal to or larger than said target flux, control said lighting system to provide light defined by said first approximation color point and said target flux; and if said highest possible flux achievable by the lighting system at said first approximation color point is lower than said target flux, determine a second approximation color point at which said lighting system is capable of providing said target flux based on a minimization of a distance in said x-y color plane between said first approximation color point and said second approximation color point; and control said lighting system to provide light defined by said second approximation color point and said target flux.

11. The lighting system according to claim 10, wherein each of said light sources comprise a plurality of light emitting devices.

12. The lighting system according to claim 10, wherein each of said light sources emit light within a predetermined distance from the black body line in the x-y color plane.

13. The lighting system according to claim 12, wherein said predetermined distance is less than 3 SDCM (Standard Deviation of Color Matching).

14. Lighting system according to claim 10, wherein said light sources emit essentially white light having different color temperature.

15. Lighting system according to claim 14, wherein said light sources emit light having color temperatures approximately equal to 2000K, 2700K, and 4400K, respectively.

* * * * *